US007690629B1

(12) United States Patent
Briggs et al.

(10) Patent No.: US 7,690,629 B1
(45) Date of Patent: Apr. 6, 2010

(54) MODULAR RAIL AND POST FENCE SYSTEM

(75) Inventors: Earl Benton Briggs, Fort Gibson, OK (US); Dean Barkley Briggs, Fort Gibson, OK (US)

(73) Assignee: Briggs Rainbow Buildings, Inc., Fort Gibson, OK (US)

( * ) Notice: Subject to any disclaimer, the term of this patent is extended or adjusted under 35 U.S.C. 154(b) by 30 days.

(21) Appl. No.: 11/758,356

(22) Filed: Jun. 5, 2007

(51) Int. Cl.
*E04H 17/00* (2006.01)

(52) U.S. Cl. ..... 256/65.12; 256/21; 256/59

(58) Field of Classification Search ..... 256/19, 256/21, 59, 65.02, 65.09, 65.11, 65.12, 65.13, 256/67, 68, 72; 403/231, 247, 382, 403; 52/656.1, 844; 312/265.1, 265.2, 265.3, 312/265.4; 211/190, 191, 192, 204, 206, 211/208

See application file for complete search history.

(56) References Cited

U.S. PATENT DOCUMENTS

| | | | | | |
|---|---|---|---|---|---|
| 236,755 | A | * | 1/1881 | Banks | 256/21 |
| 1,946,694 | A | * | 2/1934 | Hunter | 52/844 |
| 3,122,355 | A | | 2/1964 | Richardson | |
| 3,338,602 | A | | 8/1967 | Arnd | |
| 3,608,938 | A | | 9/1971 | Murdock | |
| 3,728,837 | A | * | 4/1973 | Kiefer, Jr. | 52/844 |
| 3,736,714 | A | * | 6/1973 | Brenner | 403/353 |
| 3,770,245 | A | | 11/1973 | Murdock | |
| 3,822,053 | A | | 7/1974 | Baily | |
| 4,007,919 | A | | 2/1977 | Totten | |
| 4,014,520 | A | | 3/1977 | Walters | |
| 4,140,298 | A | | 2/1979 | Coleman, Jr. | |
| 4,180,247 | A | | 12/1979 | Pfarr, Jr. | |
| 4,193,245 | A | * | 3/1980 | Johnson | 52/656.4 |
| 4,240,615 | A | * | 12/1980 | Sickler | 256/60 |
| 4,468,067 | A | | 8/1984 | Jenkins | |
| 5,150,885 | A | * | 9/1992 | Leone | 256/22 |
| 5,494,261 | A | | 2/1996 | Gandara | |
| 5,689,990 | A | | 11/1997 | Deeley | |
| 5,806,820 | A | * | 9/1998 | Simon | 211/192 |
| 5,873,564 | A | | 2/1999 | Bisch | |
| 6,042,296 | A | | 3/2000 | Wittig et al. | |
| 6,135,425 | A | | 10/2000 | Platt | |
| 6,183,879 | B1 | | 2/2001 | Deeley | |
| 6,305,671 | B1 | | 10/2001 | Valentine | |
| 6,375,166 | B1 | | 4/2002 | Schall et al. | |
| 6,499,725 | B2 | | 12/2002 | Meis et al. | |
| 6,631,887 | B1 | | 10/2003 | Walmsley | |
| 6,772,998 | B2 | * | 8/2004 | Bebendorf | 256/65.11 |
| 6,824,123 | B2 | | 11/2004 | Larsen et al. | |
| 7,025,335 | B2 | | 4/2006 | Zhu | |
| 2004/0079935 | A1 | | 4/2004 | Brucker | |
| 2006/0076546 | A1 | | 4/2006 | Bertato | |

* cited by examiner

*Primary Examiner*—Michael P Ferguson
(74) *Attorney, Agent, or Firm*—Head, Johnson & Kachigian, P.C.

(57) ABSTRACT

A modular rail and post fence system. The fence system includes a plurality of rail assemblies with each rail assembly formed from a pair of panels. Each panel has a pair of sidewalls joined together at an angle to form an angled edge wherein the pair of panels are joined together to form a rail assembly. A plurality of elongated posts are also provided. Each elongated post has at least one longitudinal recess with a pair of opposed protrusions extending into the longitudinal recess. At least one pair of notches in the pair of opposed protrusions is provided whereby the angled edges of each rail assembly are received in one pair of notches of the elongated posts. The entire system may be fabricated, assembled, and installed without fasteners.

5 Claims, 7 Drawing Sheets

MODULAR RAIL AND POST FENCE SYSTEM

BACKGROUND OF THE INVENTION

1. Field of the Invention

The present invention relates to a modular rail and post fence system that may be constructed and assembled without any fasteners. In particular, the present invention is directed to a modular rail and post fence system which may be roll formed from conventional flat metal pieces and may be shipped in component parts for storage and may be distributed and shipped to locations in the field for assembly.

2. Prior Art

Various types of rail fencing systems have been proposed in the past. In a typical system, a plurality of posts and a plurality of rails are manufactured and then shipped to distribution or sales points. The individual components are then shipped to the installation location where the posts are installed and the rails are attached to the posts by fasteners. Decreasing the costs associated with shipping and storage is desirable.

In an effort to provide modular fence systems and to ease installation, various types of connection mechanisms have been proposed in the past.

Arnd (U.S. Pat. No. 3,338,602) discloses a pair of tubular shaped pieces 1 and 2 having a square cross section which are joined together. Connecting member 3 with a flexible projection 4 joins the tubular pieces together.

Murdock (U.S. Pat. No. 3,608,938) discloses a fence system with tubular rails 36. Connectors 41 extending from fence post 12 are received in the open ends of rails 36.

Jenkins (U.S. Pat. No. 4,468,067) discloses a display ease with rail horizontal member 24 which is pinned to post frame member 14 by a hook member 60 received in open end 62 of rail 24.

Bisch (U.S. Pat. No. 5,873,564) in FIGS. 17 through 19, discloses a metal fence with a rail 204 which is held to a frame by elastic, spring-like pin 210.

Wittig et al. (U.S. Pat. No. 6,042,296) discloses a variety of panel fasteners. FIG. 11 discloses a fastener 500 with legs 513a and b to lock an adjoining panel. Ends 530a and b include camming surfaces 580a and b and locking surfaces 582a and b.

Waimsley (U.S. Pat. No. 6,631,887) in FIG. 6, discloses a rail 66 with side edges turned inward.

A number of proposals in the past have suggested eliminating conventional fasteners to secure rails to posts, for example, Schall et al. (U.S. Pat. No. 6,375,166). There nevertheless remains a need to produce a rail and post fence system that eliminates the need for any fasteners, either in manufacturing or assembling.

There have also been known snap lock joint connections for metal panels, such as button punch or Pittsburgh lock connections.

It would also be desirable to be able to ship the rails and posts and components thereof in nested fashion to reduce shipping space and shipping costs.

Accordingly, it is a principal object and purpose of the present invention to provide a modular rail and post fence system which may be constructed, assembled, and installed without use of any fasteners.

It is a further object and purpose of the present invention to provide a modular rail and post fence system wherein the individual components may be nested together for savings on shipping, transportation and storage.

It is a further object and purpose of the present invention to provide a modular rail and post fence system wherein the individual components may be roll formed from flat sheets of metal.

SUMMARY OF THE INVENTION

The present invention is directed to a modular rail and post fence system which may be both manufactured and assembled in the field without any fasteners. The fence system includes a plurality of rail assemblies, each of which are similar in construction, and a plurality of elongated posts that may be selectively configured.

Each elongated post includes a longitudinal recess. A pair of opposed protrusions extend into the recess, run parallel to each other, and also are parallel to the elongated post. At spaced positions along the protrusions of the elongated post, pairs of opposed notches are provided to allow selective installation and placement of the rail assemblies.

Each rail assembly is formed from a pair of panels. Each rail panel has a pair of flat sidewalls which are joined together at an angle to form an angled edge. The angled edge may include a protruding bead. One rail panel has a first side terminating in an opening having a hook and an opposed second side terminating in an opening having a hook. The other rail panel has opposed sides with flat edges. The pair of panels are joined together to farm a rail assembly.

In one preferred configuration, each elongated post is composed of a pair of elements. Each of the post elements includes a first can which terminates in a crimp to form an opening having a hook and a second end terminating in a plurality of button protrusions.

In order to install a rail assembly into an elongated post, one end of the rail assembly is inserted in to the recess of the post. The rail assembly is rotated about an axis perpendicular to the elongated post until the angled edges of the rail assembly are received into a pair of opposed notches.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
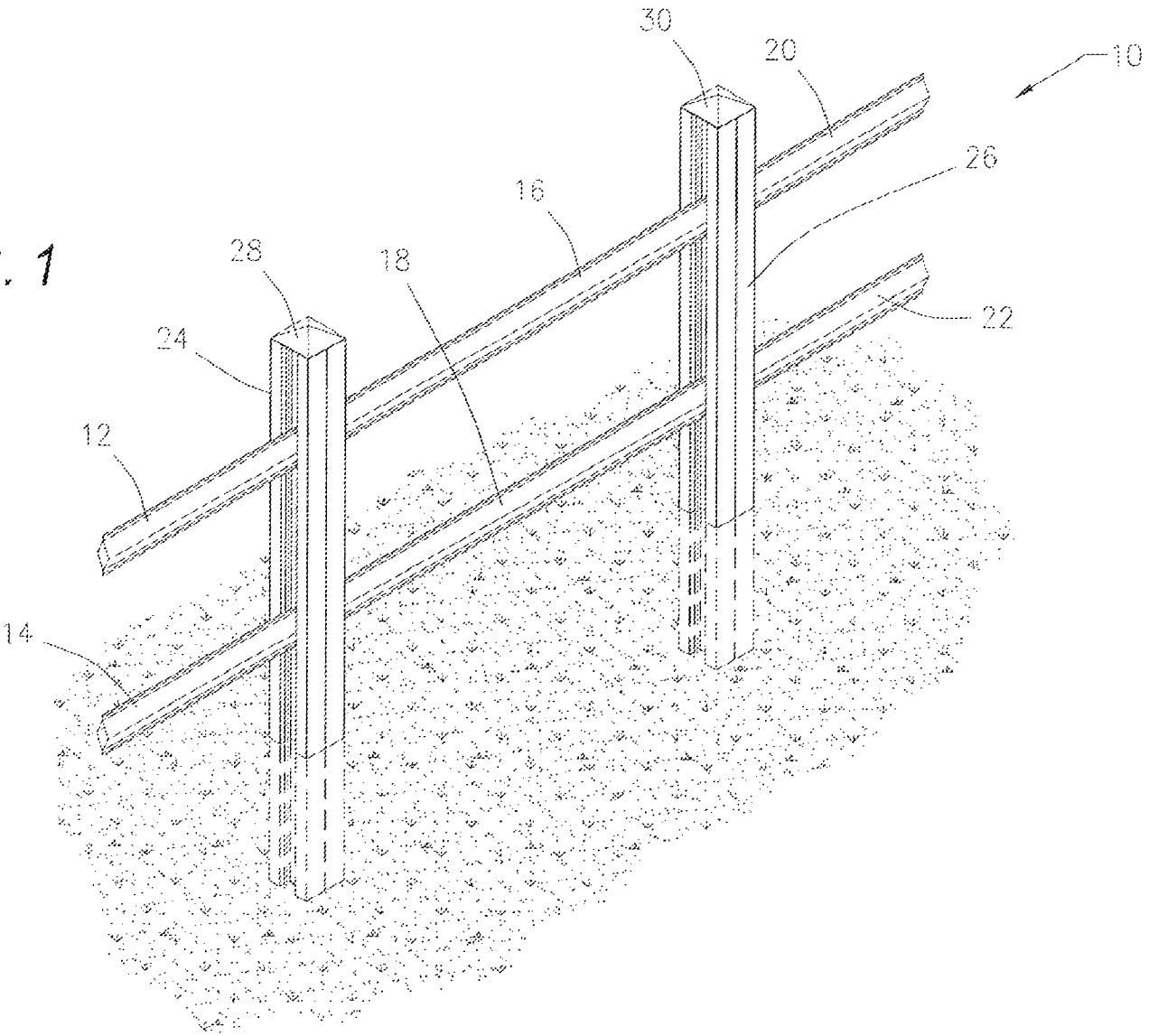
FIG. 1 is a perspective view of a modular rail and post fence system which has been assembled and constructed in accordance with the present invention.

Referring to the drawings in detail, FIG. 1 illustrates a perspective view of an initial preferred embodiment of a modular rail and post fence system 10 constructed in accordance with the present invention wherein the component elements (to be described herein in detail) have been assembled and the fence system 10 has been fully installed.

The system includes a plurality of rail assemblies 12, 14, 16, 18, 20 and 22, each of which are similar in constriction.

The modular rail and post fence system 10 also includes a plurality of elongated posts 24 and 26. As in normal fence system installation, one end of each of the elongated posts 24 and 26 is buried in the ground while the opposing end may be covered with caps 28 and 30, respectively.

The fence system 10 of the present invention may be designed so that existing post caps may be utilized with the present invention.

Figure 2:
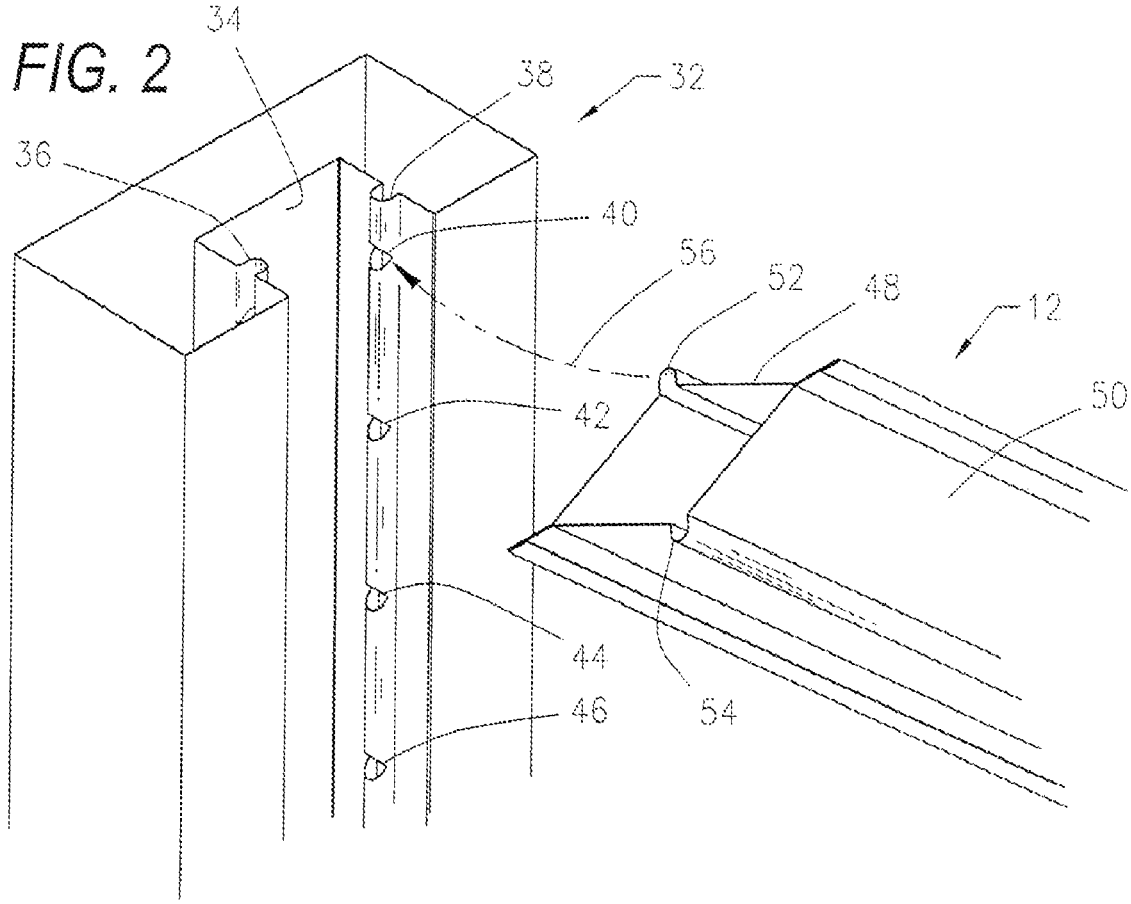
FIG. 2 is a perspective view of a rail assembly formed together from a pair of rail panels adjacent to an elongated post prior to receipt of an end of the rail assembly in the elongated post in accordance with the present invention.

FIG. 2 illustrates a perspective view of a portion of an elongated fence post 32 adjacent to a rail assembly 12. The elongated post 32 includes a longitudinal recess 34 which, in a preferred embodiment, extends the entire length of the elongated post. A pair of opposed protrusions 36 and 38 extend into the longitudinal recess. The protrusions run parallel to each other and to the elongated post. The elongated post 32 may be roil formed from fiat metal in various ways.

At spaced positions along the opposed protrusions of the elongated post 32, pairs of opposed notches are provided. One notch in each pair of notches is visible at 40, 42, 44 and 46 in FIG. 2. As will be explained in detail, the pairs of notches form the mechanism to retain the rail assemblies in position with respect to the elongated posts. In one embodiment, seven pairs of notches are provided to allow selective placement of the rail assemblies.

The rail assembly 12 is formed from a pair of rail panels 48 and 50. Each rail panel has a pair of flat sidewalls which are joined together at an angle to form an angled edge, such as shown at 52 and 54, respectively. The angled edges may include a protruding bead. The angled edges 52 and 54 will be received in the notches as suggested by arrow 56. One rail panel has a first side terminating in an opening having a hook and opposed second side terminating in an opening having a hook. The other rail panel has opposed sides with fiat edges. It will be appreciated that each rail panel may be fabricated by roll forming flat metal sheets.

Figure 3:
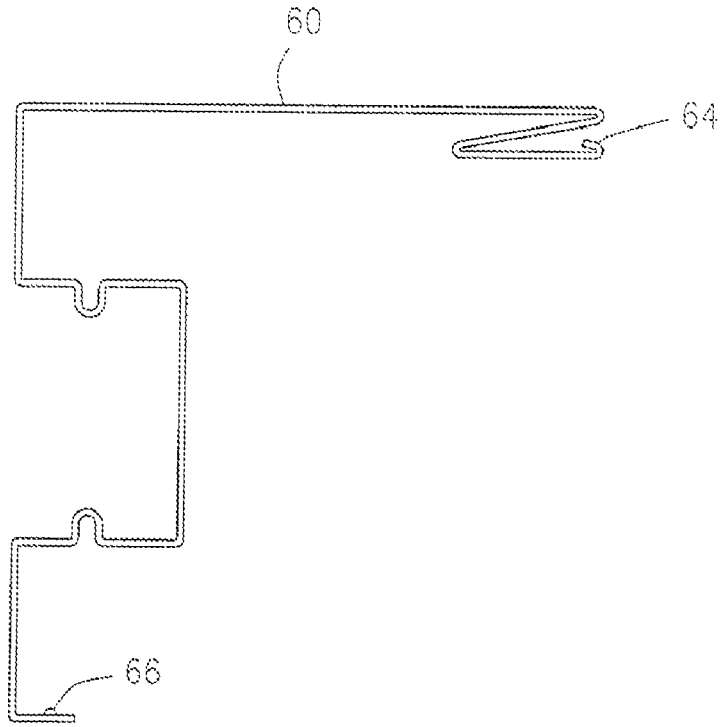
FIG. 3 illustrates a component post panel of an elongated post.
Figure 4:
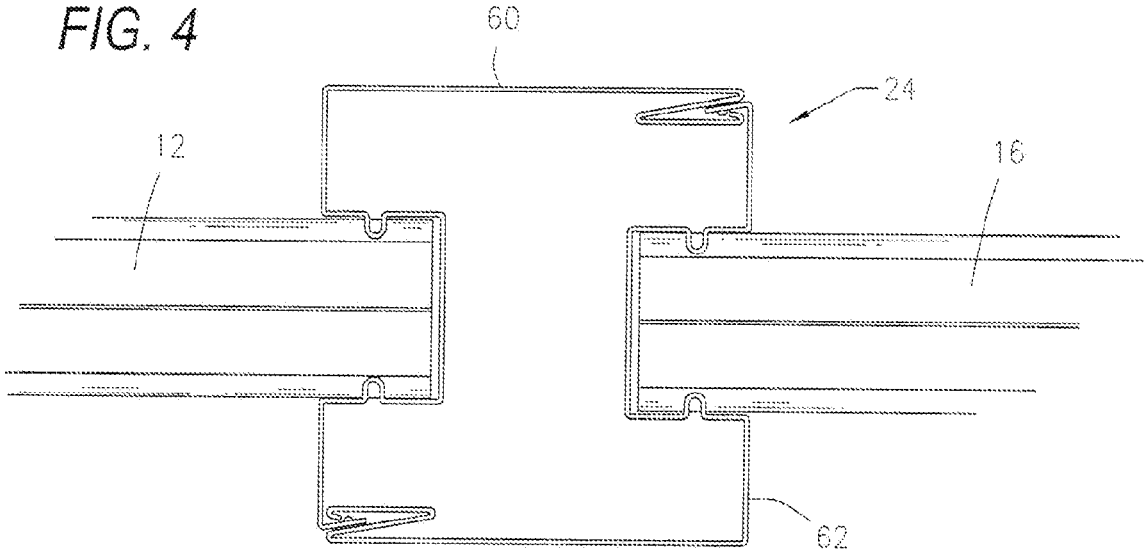
FIG. 4 illustrates an assembled elongated post along with a pair of rail assemblies.

FIGS. 3 and 4 illustrate the components of one preferred embodiment of an elongated post, such as elongated post 24. The post 24 is composed of a pair of elements 60 and 62, each formed from flat panels. The post elements 60 and 62 may be roll formed or formed in an alternate manner. Each of the post elements 60 and 62 includes a first end which terminates in a crimp to form an opening having a hook 64 and a second end terminating in a plurality of button protrusions 66. Element 62 is constructed in similar fashion so that the elongated post is assembled by inserting the end of one element with button protrusions 66 into the opposed element so that the button protrusions are trapped by the hook 64 to prevent the post from coming apart.

FIG. 4 illustrates the elongated post 24 which has been fully assembled. Rail assemblies 12 and 16 have thereafter been inserted into the recesses of the post.

Figure 5:
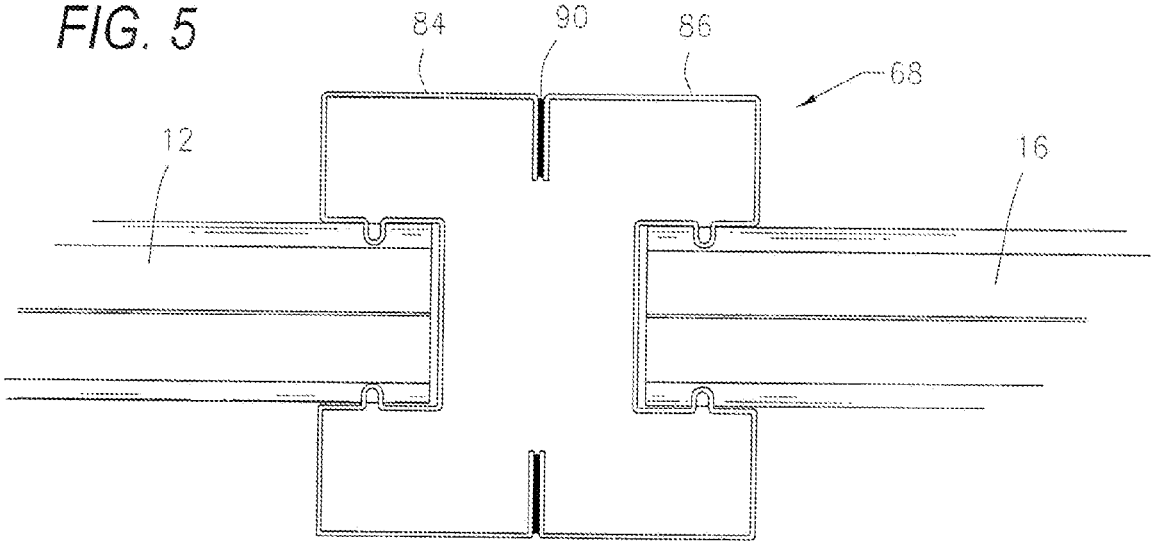
FIG. 5 illustrates an alternate embodiment of an elongated post and a pair of rail assemblies attached thereto.

FIG. 5 illustrates an alternate embodiment of an elongated post 68 which is composed of two individual elements 84 and 86 which are joined together by adhesive 90 or by other mechanism. Each element has a longitudinal recess and a pair of opposed protrusions. Each element 84 and 86 may also be roll formed from flat metal. The rail assemblies 12 and 16 are received in the longitudinal recesses in the elongated post 68 in similar fashion to that previously described.

Figure 6:
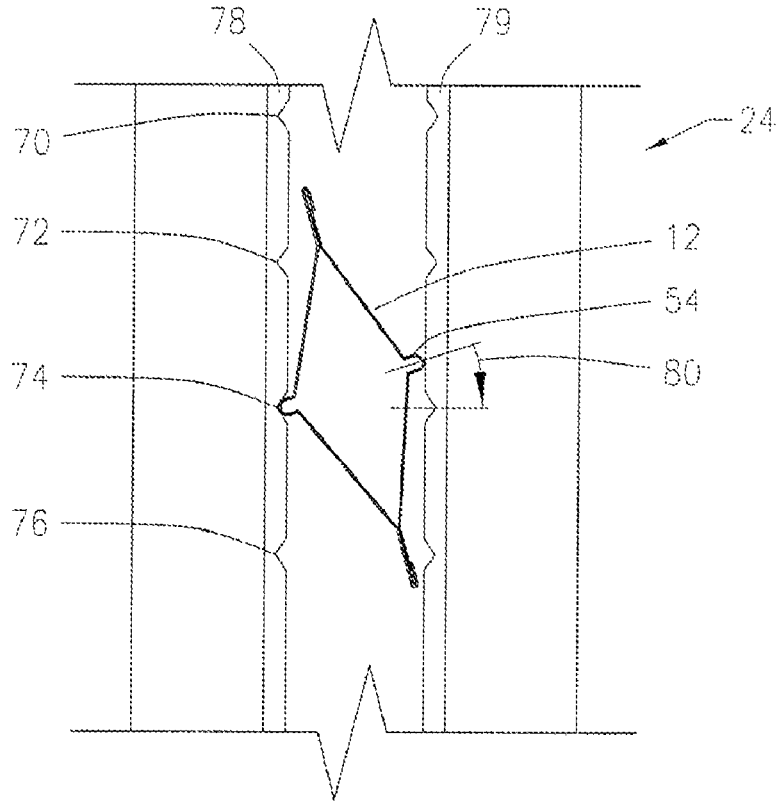
FIGS. 6 and 7 illustrates a sequential view of installation of a rail assembly with an elongated post.
Figure 7:
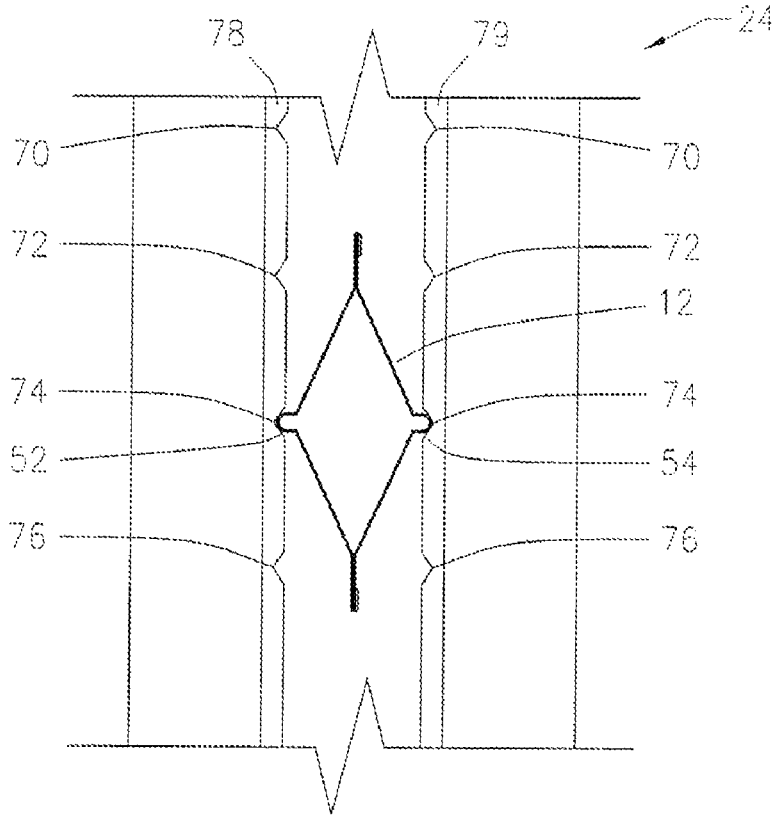

FIGS. 6 and 7 illustrate the sequential installation technique and procedure for installing a rail assembly 12 into an elongated post. The elongated post 24 includes a series of pairs of opposed notches 70, 72, 74 and 76 in the opposed protrusions 78 and 79. As shown in FIG. 6, one end of the rail assembly is inserted into the recess. The distance between the angled edges 52 and 54 of the rail assembly is greater than the distance between the protrusions 78 and 79. In order to install, one angled edge 52 of the rail assembly is inserted into one of the notches 74 while the other, opposed angled edge is angled so that the rail assembly 12 fits easily within the recess. Thereafter, as depicted by arrow 80, the rail assembly is rotated about an axis perpendicular to the elongated post 24 until the opposed angled edge 54 is received into the opposed notch 74.

Figure 8:
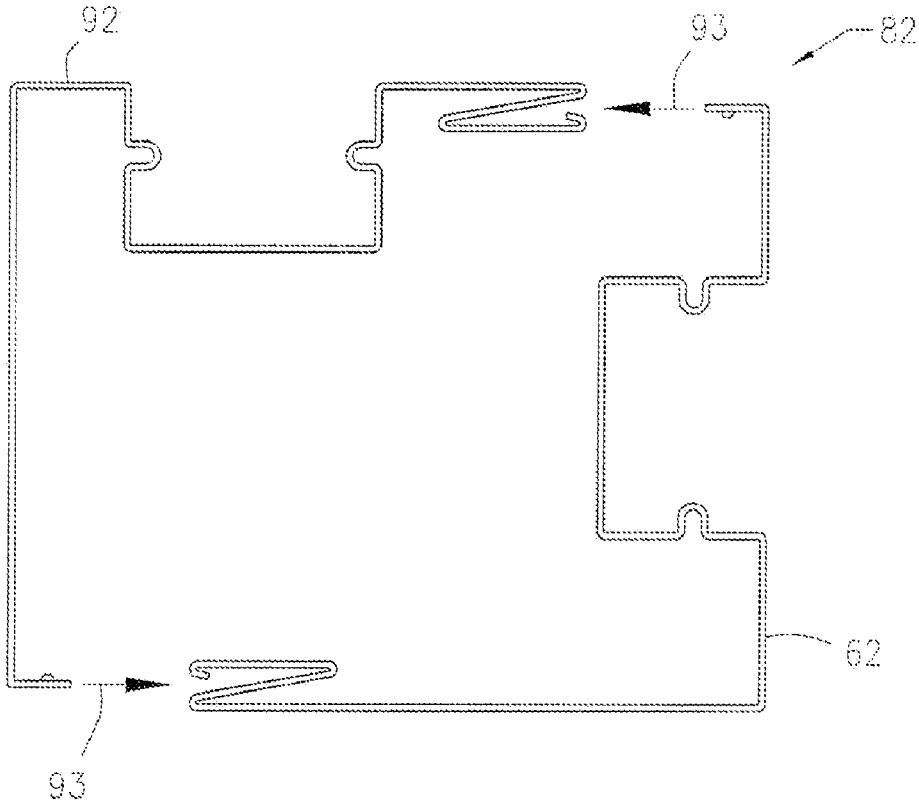
FIGS. 8 and 9 illustrates a further configuration of the elongated post shown in FIGS. 3 and 4.
Figure 9:
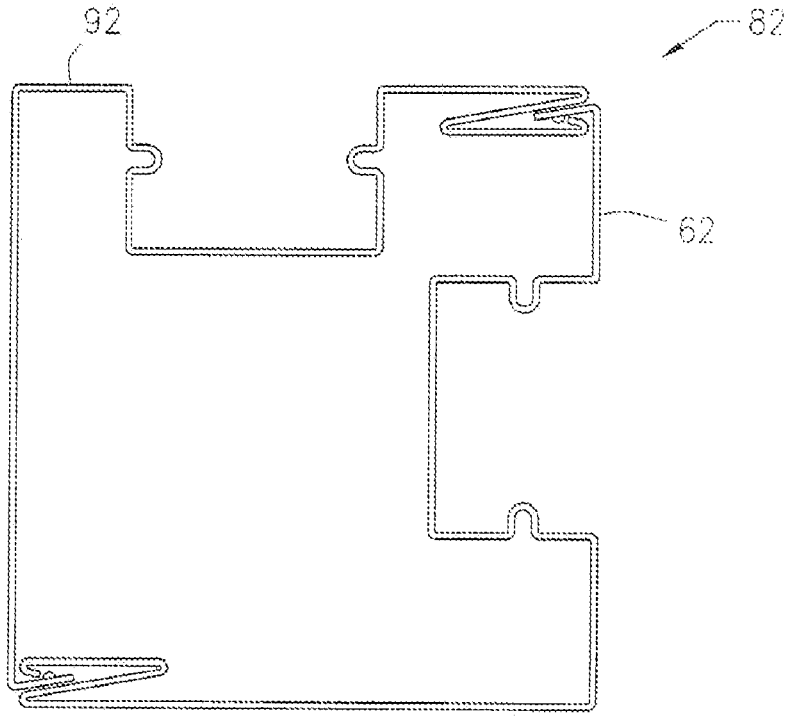

The posts may be configured in various ways. FIGS. 8 and 9 illustrate an alternate configuration of an elongated post 82. The post 82 is similar in design to the elongated post 24 although the configuration in FIGS. 8 and 9 forms a "T" connection. Other types of connections are possible within the spirit and scope of the present invention.

As seen in FIG. 8, post element 62 is joined together with post element 92 as depicted by arrows 93. Each post element includes a first end which terminates in a crimp to form an opening having a hook and a second end with a plurality of button protrusions. FIG. 9 illustrates the fully assembled elongated post 82.

Figure 10:
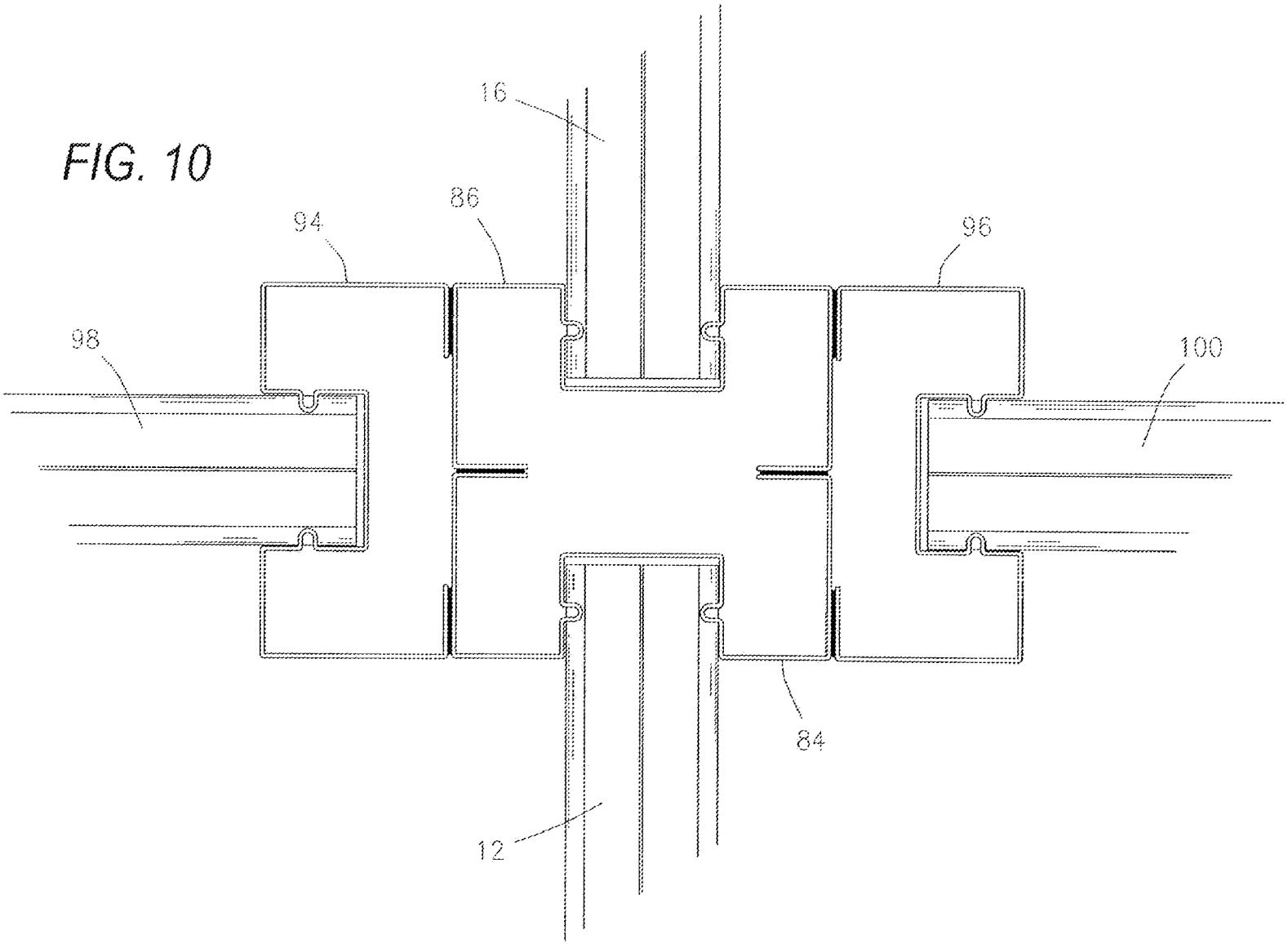
FIG. 10 illustrates an alternate embodiment of an elongated post assembly shown in FIG. 5 along with a pair of rail assemblies.

FIG. 10 illustrates an alternate embodiment of a fence post similar to the configuration in FIG. 5 with additional post elements 94 and 96 adhesively or otherwise secured to the elongated posts. The configuration shown in FIG. 10 is adapted to secure additional rail assemblies 98 and 100, respectively.

Figure 11:
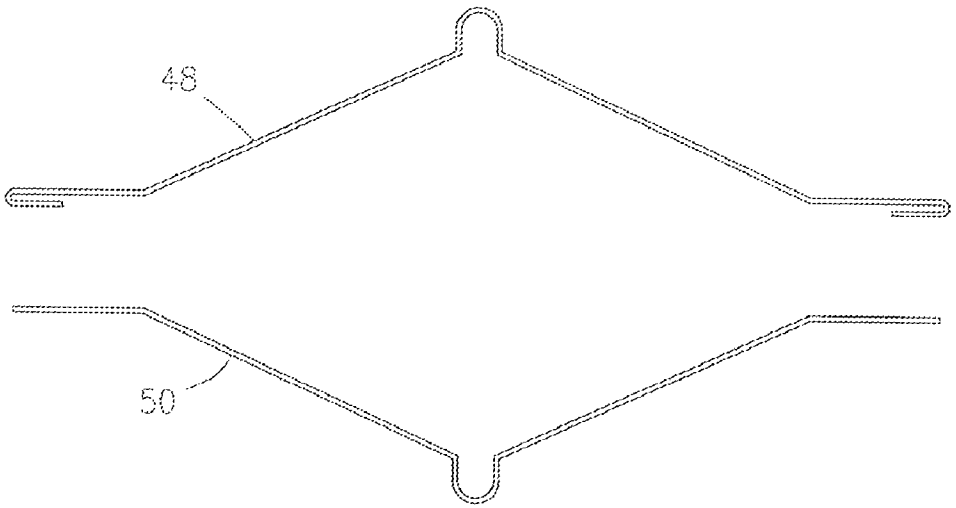
FIG. 11 is an exploded view of a rail assembly as shown in FIGS. 1 and 2.

FIG. 11 illustrates an exploded end view of one rail assembly 12 having a first rail panel 48 and a second rail panel 50.

Figure 13:
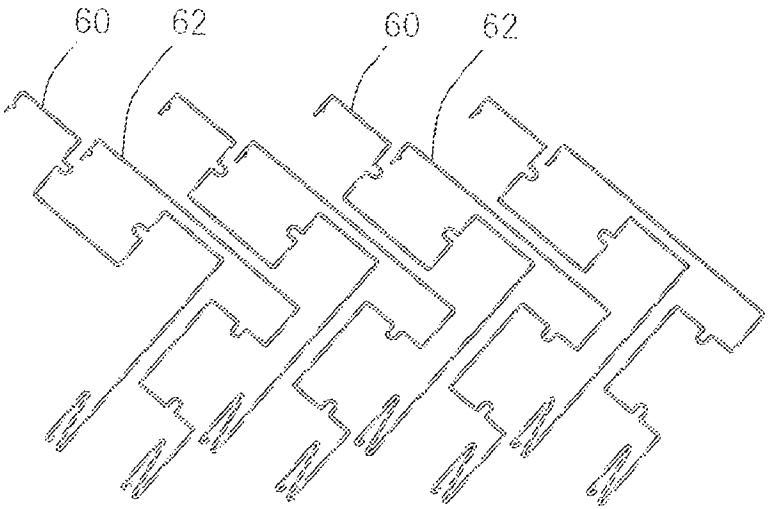
FIGS. 12 and 13 show components nested together for shipping and storage.
Figure 12:
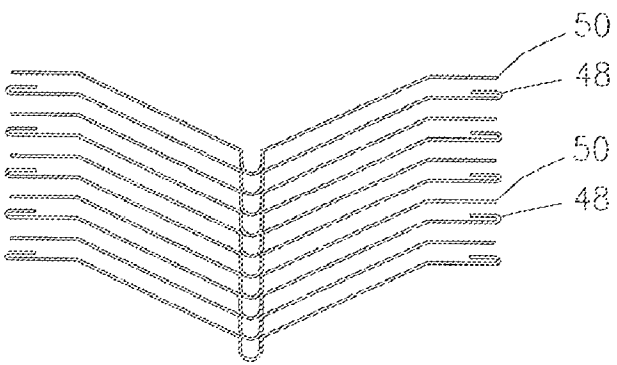

Finally, FIGS. 12 and 13 show components of the fence system 10 nested together for storage and shipment prior to assembly.

Whereas, the present invention has been described in relation to the drawings attached hereto, it should be understood that other and further modifications, apart from those shown or suggested herein, may be made within the spirit and scope of this invention.

What is claimed is:

1. A modular rail and post fence system which comprises:

a plurality of rail assemblies, each rail assembly formed from a pair of elongated rail panels, each rail panel comprising a pair of sidewalls joined at an obtuse angle to form an obtuse angled edge extending the length of said rail panel and each sidewall having a joining edge extending the length of said rail panel;

wherein each said joining edge of one of each said pair of rail panels interlockably engages a respective said joining edge of the other of said pair of rail panels, wherein said pair of rail panels are joined together to form a rail assembly having a cross-section generally shaped as a non-equiangular rhombus comprising a pair of opposed angles defined by opposed said obtuse angled edges of said pair of rail panels and a pair of opposed acute angles, each acute angle being defined between one said sidewall of one of said pair of rail panels and a respective joined sidewall of the other of said pair of rail panels, and wherein said sidewalls of each said rail panel resiliently flex about said obtuse angled edge of said rail panel to allow said opposed obtuse angled edges to be flexed toward each other; and a plurality of elongated posts, each post having at least one longitudinal recess comprising a pair of opposed longitudinally-extending sides having at least one pair of opposed notches, wherein one of said pair of notches is disposed in one of said sides of said recess and the other of said pair of notches is disposed in the other side of said recess opposite said one recess;

wherein each longitudinal end of each said rail assembly is received in a pair of said notches of a respective one of said posts, such that in an assembled position, a distance between said pair of opposed obtuse angled edges of said rail assembly is greater than a distance between said sides of said longitudinal recess of said post, and wherein in an installation position, said longitudinal end of said rail assembly is perpendicularly inserted into said longitudinal recess of said post such that said opposed obtuse angled edges of said rail assembly are flexed toward each other, and wherein in said assembled position, said rail assembly is moved so that said pair of opposed obtuse angled edges of said rail assembly are resiliently expanded and received in a respective said pair of notches of said post.

2. A modular rail and post fence system as set forth in claim 1 wherein said rail panels are each formed from flat metal and may be nested together for storage and shipping.

3. A modular rail and post fence system as set forth in claim 1 wherein each said elongated post is composed of a pair of post panels formed from flat metal.

4. A modular rail and post fence system as set forth in claim 1 wherein a plurality of pairs of notches are spaced along said longitudinal recess of each said elongated post to allow selectable placement of said rail assemblies.

5. A modular rail and post fence system as set forth in claim 1, wherein one of each said pair of rail panels has first and second said sidewalls each terminating in a joining edge comprising an opening having a hook and the other of said pair of rail panels has first and second said sidewalls each terminating in a joining edge comprising a flat edge such that each said hook from said one of said pair of rail panels receive a respective said flat joining edge from said other of said pair of rail panels.

* * * * *